US010955780B2

(12) United States Patent
Seshita et al.

(10) Patent No.: US 10,955,780 B2
(45) Date of Patent: Mar. 23, 2021

(54) FIXING DEVICE AND IMAGE FORMING APPARATUS INCORPORATING SAME

(71) Applicants: Takuya Seshita, Kanagawa (JP); Hiroshi Kajiyama, Tokyo (JP); Hitoshi Fujiwara, Kanagawa (JP)

(72) Inventors: Takuya Seshita, Kanagawa (JP); Hiroshi Kajiyama, Tokyo (JP); Hitoshi Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/897,343

(22) Filed: Jun. 10, 2020

(65) Prior Publication Data

US 2021/0011400 A1 Jan. 14, 2021

(30) Foreign Application Priority Data

Jul. 10, 2019 (JP) ..... 2019-128679

(51) Int. Cl.
*G03G 15/20* (2006.01)

(52) U.S. Cl.
CPC ..... *G03G 15/2039* (2013.01); *G03G 15/206* (2013.01); *G03G 15/2053* (2013.01); *G03G 15/2064* (2013.01)

(58) Field of Classification Search
CPC ..... G03G 15/20; G03G 15/2039; G03G 15/2053; G03G 15/206; G03G 15/2064
USPC ..... 399/107, 110, 122, 320, 328–331
See application file for complete search history.

(56) References Cited

U.S. PATENT DOCUMENTS

| | | | | |
|---|---|---|---|---|
| 9,372,448 | B2 * | 6/2016 | Hasegawa | G03G 15/2032 |
| 2017/0176906 | A1 | 6/2017 | Sawada et al. | |
| 2017/0176907 | A1 | 6/2017 | Sawada et al. | |
| 2018/0335733 | A1 | 11/2018 | Matsuda et al. | |
| 2020/0033777 | A1 | 1/2020 | Fujimoto et al. | |

FOREIGN PATENT DOCUMENTS

| | | |
|---|---|---|
| JP | 4-126260 | 11/1992 |
| JP | 10-301418 | 11/1998 |
| JP | 2006-259718 | 9/2006 |
| JP | 2009-271097 | 11/2009 |
| JP | 2013-174918 | 9/2013 |
| JP | 2015-206859 | 11/2015 |
| JP | 2017-199604 | 11/2017 |

* cited by examiner

*Primary Examiner* — Hoan H Tran
(74) *Attorney, Agent, or Firm* — Oblon, McClelland, Maier & Neustadt, L.L.P.

(57) ABSTRACT

A fixing device includes a fixing rotator, a pressure rotator configured to press the fixing rotator, a fixing structure, a temperature detector, a discharger, and a holder. The fixing structure is configured to hold at least one of the fixing rotator and the pressure rotator. The temperature detector is configured to contact a detected member that is at least one of the fixing rotator and the pressure rotator and detect a temperature of the detected member. The discharger is configured to contact and discharge the detected member. The holder is fixed on the fixing structure and configured to hold the temperature detector and the discharger.

13 Claims, 11 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2019-128679, filed on Jul. 10, 2019 in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Background Art

One type of fixing device includes a fixing rotator, a pressure rotator that contacts and presses the fixing rotator, a fixing structure to hold at least one of the fixing rotator and the pressure rotator, and a temperature detector that contacts the fixing rotator or the pressure rotator and detects a temperature of the fixing rotator or the pressure rotator.

SUMMARY

This specification describes an improved fixing device that includes a fixing rotator, a pressure rotator configured to press the fixing rotator, a fixing structure, a temperature detector, a discharger, and a holder. The fixing structure is configured to hold at least one of the fixing rotator and the pressure rotator. The temperature detector is configured to contact a detected member that is at least one of the fixing rotator and the pressure rotator and detect a temperature of the detected member. The discharger is configured to contact and discharge the detected member. The holder is fixed on the fixing structure and configured to hold the temperature detector and the discharger.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
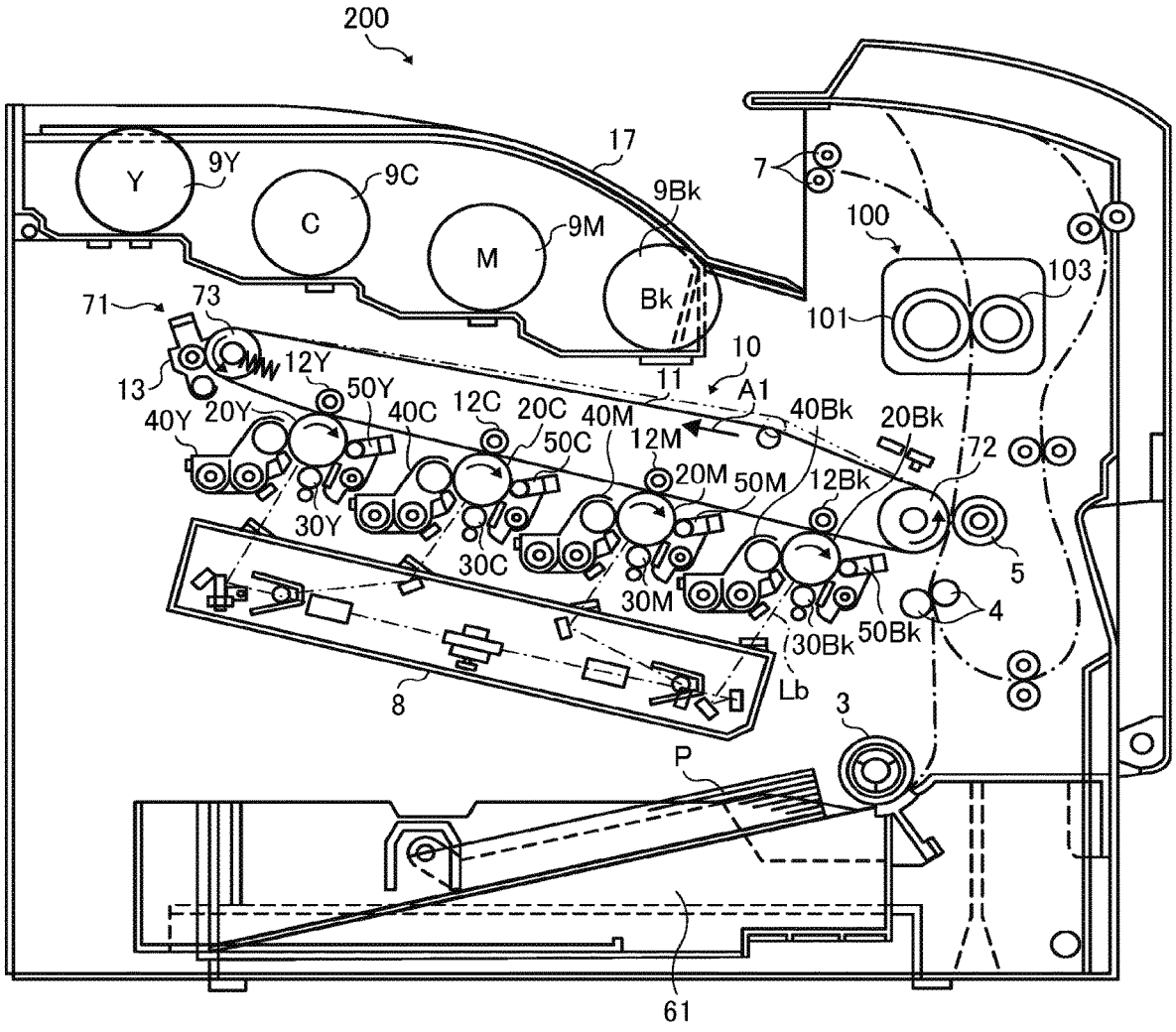
FIG. 1 is a schematic view illustrating a configuration of an image forming apparatus according to a present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

As an image forming apparatus including a fixing device to which the present disclosure is applied, one embodiment of a color electrophotographic image forming apparatus (hereinafter, referred to as an image forming apparatus 200) is described below.

FIG. 1 is a schematic view illustrating a configuration of the image forming apparatus 200 according to a present embodiment.

First, with reference to FIG. 1, a description is given of the configuration of the image forming apparatus 200 according to the present embodiment.

The image forming apparatus 200 illustrated in FIG. 1 is a color printer employing a tandem system in which a plurality of image forming devices for forming toner images in a plurality of colors, respectively, is aligned in a stretch direction of a transfer belt 11 serving as an intermediate transferor. Alternatively, the image forming apparatus 200 including the fixing device to which the present disclosure is applied may employ other systems and may be a copier, a facsimile machine, a printer, a multifunction peripheral or a multifunction printer (MFP) having two or more of copying, printing, scanning, facsimile, and plotter functions, or the like.

The image forming apparatus 200 employs a tandem structure in which four photoconductor drums 20Y, 20C, 20M, and 20Bk serving as image bearers that bear yellow, cyan, magenta, and black toner images in separation colors, respectively, are aligned. In the image forming apparatus 200, the yellow, cyan, magenta, and black toner images formed on the photoconductor drums 20Y, 20C, 20M, and 20Bk, respectively, are primarily transferred successively onto the transfer belt 11 serving as an intermediate transferor that is an endless belt disposed opposite the photoconductor drums 20Y, 20C, 20M, and 20Bk as the transfer belt 11 rotates in a rotation direction A1 such that the yellow, cyan, magenta, and black toner images are superimposed on a same position on the transfer belt 11 in a primary transfer process. Through the primary transfer process, the yellow, cyan, magenta, and black toner images are superimposed on the transfer belt 11 and then secondarily transferred onto a sheet P serving as a recording medium having a sheet form collectively in a secondary transfer process.

Each of the photoconductor drums 20Y, 20C, 20M, and 20Bk is surrounded by image forming components that form the yellow, cyan, magenta, and black toner images on the photoconductor drums 20Y, 20C, 20M, and 20Bk as the photoconductor drums 20Y, 20C, 20M, and 20Bk rotate clockwise in FIG. 1. Taking the photoconductor drum 20Bk that forms the black toner image, the following describes an image forming operation to form the black toner image. The photoconductor drum 20Bk is surrounded by a charger 30Bk, a developing device 40Bk, a primary transfer roller 12Bk, and a cleaner 50Bk in this order in a rotation direction of the photoconductor drum 20Bk. The photoconductor drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in a rotation direction of the photoconductor drums 20Y, 20C, and 20M, respectively. After the charger 30Bk uniformly charges the photoconductor drum 20Bk, an optical writing device 8 writes an electrostatic latent image on the photoconductor drum 20Bk with a laser beam Lb.

As the transfer belt 11 rotates in the rotation direction A1 in FIG. 1, the yellow, cyan, magenta, and black toner images formed on the photoconductor drums 20Y, 20C, 20M, and 20Bk, respectively, are primarily transferred successively onto the transfer belt 11, thus being superimposed on the same position on the transfer belt 11. In the primary transfer process, the primary transfer rollers 12Y, 12C, 12M, and 12Bk disposed opposite the photoconductor drums 20Y, 20C, 20M, and 20Bk via the transfer belt 11, respectively, apply a voltage to the photoconductor drums 20Y, 20C, 20M, and 20Bk successively from the upstream photoconductor drum 20Y to the downstream photoconductor drum 20Bk in the rotation direction A1 of the transfer belt 11 in FIG. 1.

The photoconductor drums 20Y, 20C, 20M, and 20Bk are aligned in this order in the rotation direction A1 of the transfer belt 11. The photoconductor drums 20Y, 20C, 20M, and 20Bk are located in four image forming stations that form the yellow, cyan, magenta, and black toner images, respectively.

The image forming apparatus 200 includes the four image forming stations that form the yellow, cyan, magenta, and black toner images, respectively, a transfer belt unit 10, a secondary transfer roller 5, a transfer belt cleaner 13, and the optical writing device 8. The transfer belt unit 10 is situated above and disposed opposite the photoconductor drums 20Y, 20C, 20M, and 20Bk. The transfer belt unit 10 incorporates the transfer belt 11 and the primary transfer rollers 12Y, 12C, 12M, and 12Bk. The secondary transfer roller 5 is disposed opposite the transfer belt 11 and driven and rotated in accordance with rotation of the transfer belt 11. The transfer belt cleaner 13 is disposed opposite the transfer belt 11 to clean the transfer belt 11. The optical writing device 8 is situated below and disposed opposite the four image forming stations.

The optical writing device 8 includes a semiconductor laser as a light source that writes an electrostatic latent image, a coupling lens, an fθ lens, a toroidal lens, a deflection mirror, and a rotatable polygon mirror serving as a deflector. The optical writing device 8 emits light beams Lb corresponding to the yellow, cyan, magenta, and black toner images to be formed on the photoconductor drums 20Y, 20C, 20M, and 20Bk thereto, forming electrostatic latent images on the photoconductor drums 20Y, 20C, 20M, and 20Bk, respectively. FIG. 1 illustrates the light beam Lb irradiating the photoconductor drum 20Bk. Similarly, light beams Lb irradiate the photoconductor drums 20Y, 20C, and 20M, respectively.

The image forming apparatus 200 further includes a sheet feeder 61 and a registration roller pair 4. The sheet feeder 61 incorporates a paper tray that loads a plurality of sheets P to be conveyed to a secondary transfer nip formed between the transfer belt 11 and the secondary transfer roller 5. The registration roller pair 4 conveys a sheet P conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 200 further includes a sensor that detects a leading edge of the sheet P as the sheet P reaches the registration roller pair 4.

The image forming apparatus 200 further includes a fixing device 100, an output roller pair 7, and an output tray 17. The fixing device 100, as a fixing unit employing a contact heating system to heat the sheet P, includes a fixing belt 101 and a pressure roller 103 that fix a color toner image formed by the yellow, cyan, magenta, and black toner images secondarily transferred from the transfer belt 11 onto the sheet P thereon. The output roller pair 7 ejects the sheet P bearing the fixed color toner image onto an outside of the image forming apparatus 200, that is, the output tray 17. The output tray 17 is disposed atop the image forming apparatus 200 and stacks the sheet P ejected by the output roller pair 7. Toner bottles 9Y, 9C, 9M, and 9Bk are situated below the output tray 17 and inside the image forming apparatus 200. The toner bottles 9Y, 9C, 9M, and 9Bk are replenished with fresh yellow, cyan, magenta, and black toners, respectively.

The transfer belt unit 10 includes a drive roller 72 and a driven roller 73 around which the transfer belt 11 is wound, in addition to the transfer belt 11 and the primary transfer rollers 12Y, 12C, 12M, and 12Bk. Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12Bk, the secondary transfer roller 5, and the transfer belt cleaner 13 construct a transfer device 71.

The sheet feeder 61 is situated in a lower portion of the image forming apparatus 200 and includes a feed roller 3 that contacts an upper side of an uppermost sheet P of the plurality of sheets P loaded on the paper tray of the sheet feeder 61. As the feed roller 3 is driven and rotated counterclockwise in FIG. 1, the feed roller 3 feeds the uppermost sheet P to the registration roller pair 4.

The transfer belt cleaner 13 of the transfer device 71 includes a cleaning brush and a cleaning blade being disposed opposite and contacting the transfer belt 11. The cleaning brush and the cleaning blade scrape a foreign substance such as residual toner off the transfer belt 11, removing the foreign substance from the transfer belt 11 and thereby cleaning the transfer belt 11. The transfer belt cleaner 13 further includes a waste toner conveyer that conveys and discards the residual toner removed from the transfer belt 11.

Figure 2:
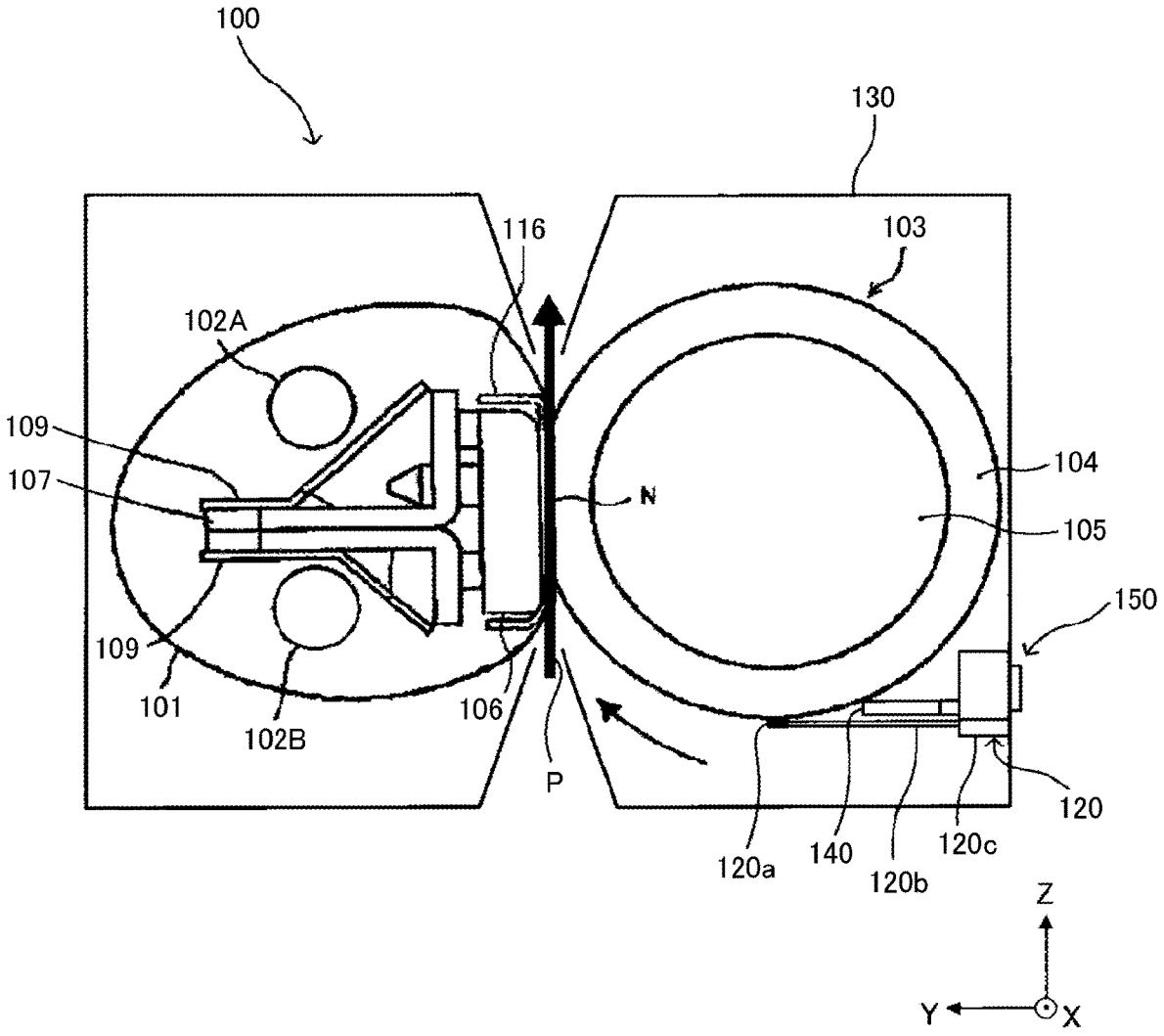
FIG. 2 is an explanatory view illustrating a schematic configuration of a fixing device.

FIG. 2 is an explanatory view illustrating a schematic configuration of the fixing device 100.

In the following description, as illustrated in FIG. 2, a Z direction is a vertical direction that is also a sheet conveyance direction, an X direction is a rotation axis direction of the pressure roller 103, and a Y direction is a direction orthogonal to the X direction and the Z direction. The Y direction is also a direction in which the pressure roller 103 presses the fixing belt 101.

As illustrated in FIG. 2, the fixing device 100 includes the fixing belt 101 as a rotatable endless fixing rotator and the pressure roller 103 as a rotatable pressure rotator disposed opposite the fixing belt 101. The fixing device 100 includes two halogen heaters 102, that is, a first halogen heater 102A and a second halogen heater 102B, as a plurality of heaters or a plurality of fixing heaters that heats the fixing belt 101 in a non-nip portion other than a fixing nip N in FIG. 2. The first halogen heater 102A and the second halogen heater 102B directly heat the fixing belt 101 with light irradiating an inner circumferential surface of the fixing belt 101, thus heating the fixing belt 101 with radiation heat.

Inside a loop of the fixing belt 101, the fixing device 100 illustrated in FIG. 2 includes a nip formation pad 106 that presses against the pressure roller 103 via the fixing belt 101 to form the fixing nip N between the fixing belt 101 and the pressure roller 103. As the fixing belt 101 rotates, the inner circumferential surface of the fixing belt 101 slides over the nip formation pad 106 indirectly via a thermal conduction aid 116. As the sheet P bearing the toner image is conveyed through the fixing nip N in the sheet conveyance direction, the fixing belt 101 and the pressure roller 103 fix the toner image on the sheet P under heat and pressure.

As illustrated in FIG. 2, a surface of the thermal conduction aid 116 facing an inner circumferential surface of the fixing belt 101 is planar but alternatively may define a recess or other shapes. If the fixing nip N defines the recess, the recessed fixing nip N directs the leading edge of the sheet P toward the pressure roller 103 as the sheet P is ejected from the fixing nip N, facilitating separation of the sheet P from the fixing belt 101 and preventing jamming of the sheet P.

Additionally, the thermal conduction aid 116 functions as a facing part of the nip formation pad 106 facing the fixing belt 101.

The nip formation pad 106 inside the loop of the fixing belt 101 is disposed opposite the pressure roller 103 via the fixing belt 101. Two lateral end heaters are mounted on or coupled with both lateral ends of the nip formation pad 106 in a longitudinal direction thereof, respectively. The lateral end heaters as end portion heaters heat the fixing belt 101 at the fixing nip N. The thermal conduction aid 116 covers a surface of the nip formation pad 106 and a surface of each lateral end heater which are opposite the inner circumferential surface of the fixing belt 101. In addition, the fixing device 100 includes a stay 107 that holds the nip formation pad 106 against pressure from the pressure roller 103.

Each of the nip formation pad 106, the thermal conduction aid 116, and the stay 107 has a width not smaller than a width of the fixing belt 101 in an axial direction or a longitudinal direction of the fixing belt 101 parallel to a longitudinal direction of the nip formation pad 206, the thermal conduction aid 216, and the stay 207.

The thermal conduction aid 116 prevents heat generated by the lateral end heaters from being stored locally and facilitates conduction of heat in the longitudinal direction of the thermal conduction aid 116, thus reducing uneven temperature of the fixing belt 101 in the axial direction thereof.

Hence, the thermal conduction aid 116 is preferably made of a material that conducts heat quickly, for example, a material having an increased thermal conductivity such as copper, aluminum, or silver. It is preferable that the thermal conduction aid 116 is made of copper in a comprehensive view of manufacturing costs, availability, thermal conductivity, and processing.

In the fixing device 100 according to the present embodiment, the thermal conduction aid 116 has a nip formation surface disposed opposite the inner circumferential surface of the fixing belt 101 and in direct contact with the inner circumferential surface of the fixing belt 101.

The fixing belt 101 is an endless belt or film made of metal, such as nickel or stainless steel (e.g., steel use stainless or SUS), or resin such as polyimide.

The fixing belt 101 is constructed of a base layer and a release layer. The release layer constituting an outer surface layer is made of perfluoroalkoxy alkane (PFA), polytetrafluoroethylene (PTFE), or the like to facilitate separation of toner of the toner image on the sheet P from the fixing belt 201, thus preventing the toner of the toner image from adhering to the fixing belt 101.

The fixing belt 101 may include an elastic layer sandwiched between the base layer and the release layer and made of silicone rubber or the like. The fixing belt 101 that does not incorporate the elastic layer made of silicone rubber has a small thermal capacity that improves fixing property of being heated quickly to a desired fixing temperature at which the toner image is fixed on the sheet P. However, as the fixing belt 101 presses the unfixed toner image on the sheet P, slight surface asperities in the fixing belt 101 are transferred onto the toner image on the sheet P, resulting in variation in gloss of the solid toner image that may appear as an orange peel image on the sheet P. To address this circumstance, the elastic layer made of silicone rubber has a thickness not smaller than 100 μm. Deformation of the elastic layer made of silicone rubber absorbs the slight surface asperities in the fixing belt 101, preventing formation of the faulty orange peel image.

The stay 107 has a shape having a projection projected from a surface of the stay 107 opposite the fixing nip N, that is, the surface of the stay 107 different from a surface of the stay 107 facing the fixing nip N. The projection separates a first halogen heater 102A and a second halogen heater 102B as fixing heat sources from each other. These two halogen heaters 102, that is, the first halogen heater 102A and the second halogen heater 102B directly heat the inner circumferential surface of the fixing belt 101 with radiant heat.

Disposing halogen heaters 102 inside the loop of the fixing belt 101 easily downsizes the fixing device 100 including the rotatable endless fixing belt 101.

The above-described stay 107 as a support member is disposed inside the loop of the fixing belt 101 to support the nip formation pad 106 and form the fixing nip N. As the nip formation pad 106 receives pressure from the pressure roller 103, the stay 107 supports the nip formation pad 106 to prevent bending of the nip formation pad 106 and produce an even nip length in the sheet conveyance direction throughout the entire width of the fixing belt 101 in the axial direction thereof.

A fixing structure such as a frame 130 holds and fixes both ends of the stay 107 to position the stay 107. Between the stay 107 and each of the two halogen heaters 102, a reflector 109 is disposed to prevent the stay 107 from being heated by the radiant heat from the halogen heaters 102 and reduce wasteful energy consumption.

Alternatively, instead of the reflector 109, an opposed face of the stay 107 disposed opposite the halogen heaters 102A and 102B may be treated with insulation or mirror finish to obtain similar effects.

The frame 130 rotatably holds and positions the pressure roller 103. The pressure roller 103 includes a cored bar 105, an elastic rubber layer 104 on an outer peripheral surface of the cored bar 105, and a release layer made of PFA or PTFE on a surface of the elastic rubber layer 104 to facilitate separation of the sheet P from the pressure roller 103.

A driver such as a motor disposed inside the image forming apparatus 200 generates a driving force, and the driving force is transmitted to the pressure roller 103 through a gear train to rotate the pressure roller 103. A spring or the like presses the pressure roller 103 against the fixing belt 101, and the elastic rubber layer 104 is compressed and deformed so that the fixing nip N has a predetermined nip width.

The pressure roller 103 may be a hollow roller and include a heating source such as a halogen heater.

The elastic rubber layer 104 may be made of solid rubber. Alternatively, if no heater is disposed inside the pressure roller 103, the elastic rubber layer 104 may be made of sponge rubber. The sponge rubber is preferable to the solid rubber because the sponge rubber has enhanced thermal insulation and so draws less heat from the fixing belt 101.

The fixing belt 101 rotates in accordance with rotation of the pressure roller 103. In the embodiment illustrated in FIG. 2, as the driver rotates the pressure roller 103, the driving force is transmitted from the pressure roller 103 to the fixing belt 101 at the fixing nip N, thus rotating the fixing belt 101 by friction between the pressure roller 103 and the fixing belt 101.

At the fixing nip N, the fixing belt 101 rotates while being sandwiched between the pressure roller 103 and the nip formation pad 106. At a circumferential span of the fixing belt 101 other than the fixing nip N, flanges disposed in the frame 130 guide both ends of the fixing belt 101 rotating.

With the configuration described above, the fixing device 100 attaining quick warm-up is manufactured at reduced costs.

The fixing device 100 includes a thermistor 120 as a temperature detector that contacts the surface of the pressure roller 103 and detects the temperature of the pressure roller 103. The thermistor 120 includes a temperature detection unit 120*a*, an IC chip 120*c*, and a conducting wire 120*b* that electrically couples the IC chip 120*c* and the temperature detection unit 120*a*. The temperature detection unit 120*a* includes an element whose resistance value varies with temperature. The IC chip 120*c* applies a voltage and measures the resistance to detect the temperature. In the present embodiment, turning on or off the first halogen heater 102A and the second halogen heater 102B is controlled based on the temperature of the pressure roller 103 as the detected member detected by the thermistor 120.

The fixing device 100 includes a discharge brush 140 as a discharger that comes into contact with the surface of the pressure roller 103 to discharge the pressure roller 103. Providing the discharge brush 140 and discharging the pressure roller 103 can reduce an electrostatic attraction force between the sheet P and the pressure roller 103 and favorably separate the sheet P from the pressure roller 103. In addition, discharging the pressure roller 103 can prevent an occurrence of an electrostatic offset in which toner on the sheet P adheres to the fixing belt 101 due to a potential difference between the fixing belt 101 and the pressure roller 103.

The discharge brush 140 and the thermistor 120 are held by a holder 150, and the holder 150 is screwed to the frame 130.

Figure 3:
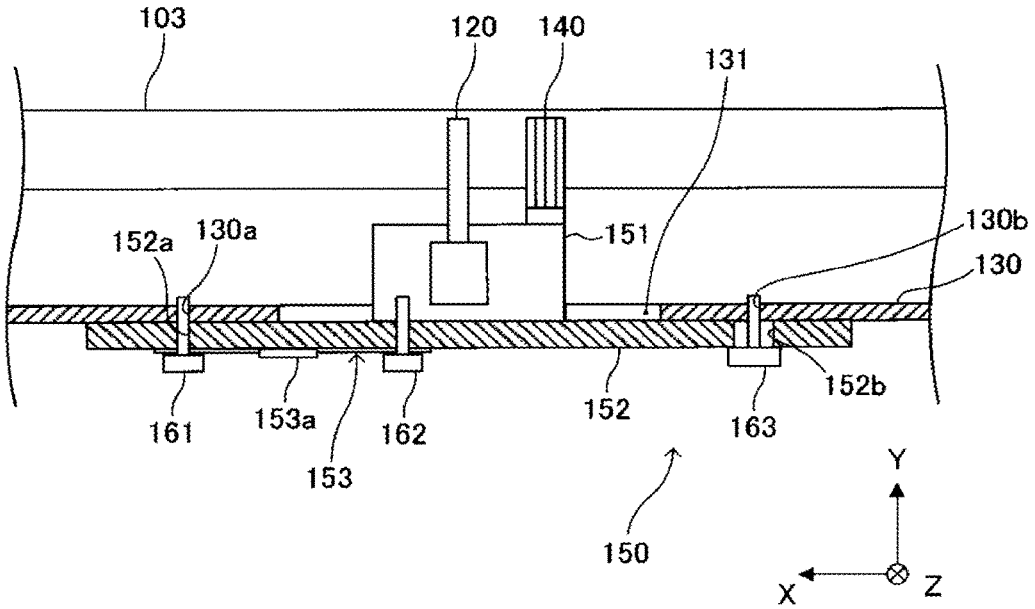
FIG. 3 is a schematic view illustrating a configuration of a holder viewed from a-Z direction.
Figure 4:
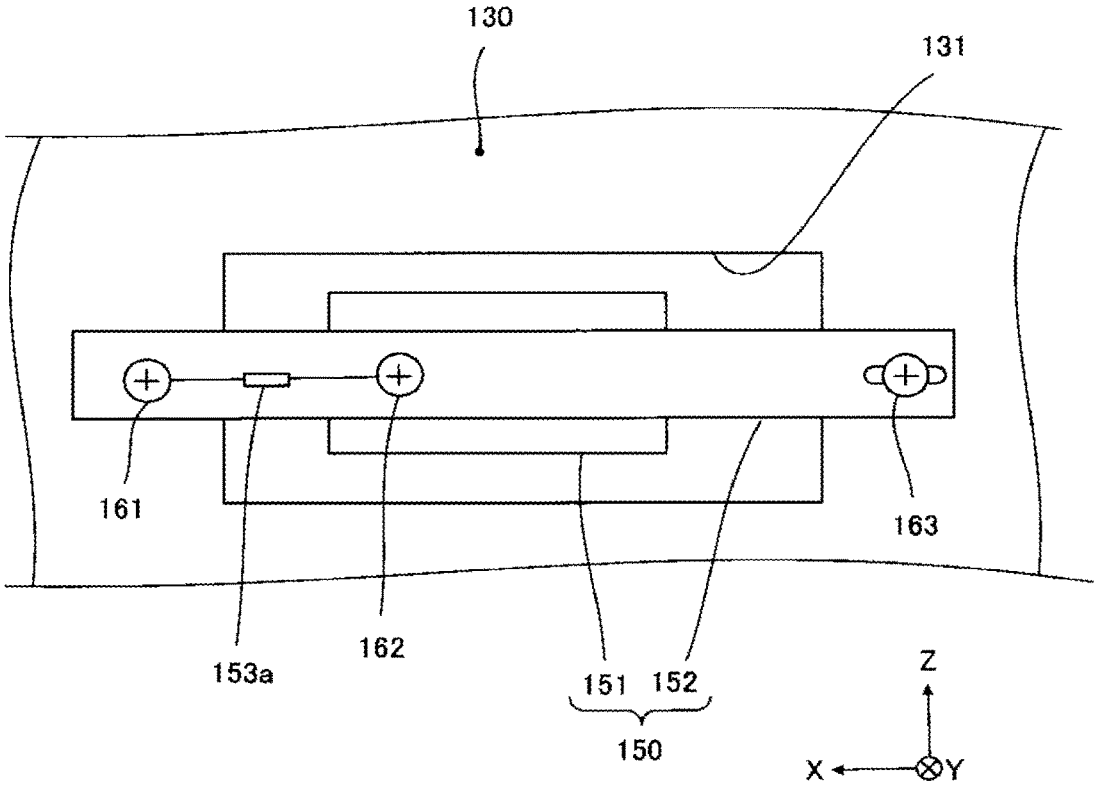
FIG. 4 is a schematic view illustrating a configuration of the holder viewed from a-Y direction.

FIG. 3 is a schematic view illustrating a configuration of the holder 150 viewed from a −Z direction, that is, from a bottom side in FIG. 2. FIG. 4 is a schematic view illustrating a configuration of the holder 150 viewed from a −Y direction, that is, from a right side in FIG. 2.

The holder 150 includes a bracket 151 as a support that holds the discharge brush 140 and the thermistor 120 and a base 152 that is a plate to fix the holder 150 to the frame 130. The bracket 151 is made of metal and is fixed to the base 152 with a bracket fixing screw 162. The base 152 is made of an insulating resin. The base 152 has a screw through-hole 152*a* in one end portion and a screw through-hole 152*b* in the other end portion in the X direction. The screws 161 and 163 are inserted into the screw through-hole 152*a* and 152*b*. The screw through-hole 152*b* in the other end portion (the portion in a −X direction side in FIG. 4) is a slot extending in the X direction. The holder 150 is screwed to the frame 130 by inserting the screws 161 and 163 into the screw through-holes 152*a* and 152*b* and screwing the screws 161 and 163 into the screw holes 130*a* and 130*b* provided in the frame 130.

Additionally, the holder 150 includes the resistance member 153 as a resistor including a resistance unit 153*a*. Specifically, one end portion of the resistance member 153 is sandwiched between the head of the bracket fixing screw 162 and the base 152 and held on the base 152, and the other end portion of the resistance member 153 is sandwiched between the head of the screw 161 and the base 152 and held on the base 152. The above-described configuration electrically couples the discharge brush 140 to the frame 130 made of metal and grounded via the bracket 151 made of metal, the bracket fixing screw 162 made of metal, the resistance member 153, and the screw 161 made of metal. An electrical resistance value of the resistance unit 153*a* of the resistance member 153 is set higher than an electrical resistance value of the frame 130 and lower than an electrical resistance value of the base 152 to flow an appropriate current.

The base 152 made of metal easily flows an electric current between the discharge brush 140 and the frame 130. As a result, the base 152 made of metal is helpful to discharge the pressure roller 103 but may cause following problems. That is, when the sheet P is sandwiched by both the fixing nip N and a transfer nip, a transfer current may leak from the transfer nip to the discharge brush 140 via the sheet P and the pressure roller 103, and transfer failure may occur. To avoid the transfer failure, conceivably, for example, the base 152 may be made of material having an electrical resistance adjusted by containing a conductive material such as carbon in resin. However, adjusting the electrical resistance of the base 152 to suitably flow the transfer current is difficult. Even if the material having the electrical resistance adjusted to suitably flow the transfer current can be made, the base 152 becomes expensive.

In the present embodiment, the base 152 is made of an inexpensive insulating resin, and the holder 150 holds the resistance member 153 including the resistance unit 153*a* having the electrical resistance to suitably flow the transfer current. The resistance member 153 electrically couples between the discharge brush 140 and the grounded frame 130. The above-described configuration enables inexpensively and easily designing the electrical resistance between the discharge brush 140 and the frame 130 to suitably flow the transfer current. Therefore, the above-described configuration can inexpensively and easily reduce a leakage of the transfer current to the discharge brush 140 and discharge the pressure roller 103.

Figure 5:
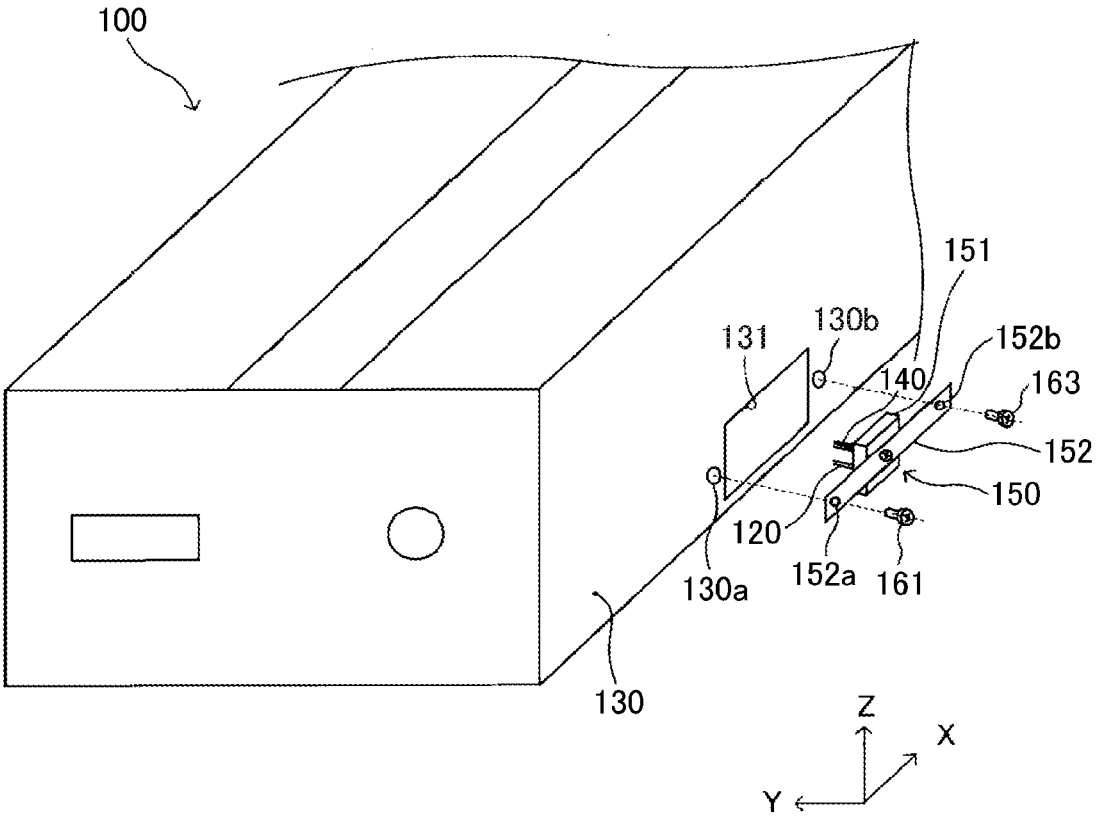
FIG. 5 is an exploded perspective view illustrating a frame and the holder.

FIG. 5 is an exploded perspective view illustrating the frame 130 and the holder 150.

As illustrated in FIG. 5, the frame 130 has a rectangular opening 131 and screw holes 130*a* and 130*b* disposed outside both ends of the rectangular opening 131 in the X direction, that is, the axial direction of the pressure roller 103. Thread grooves are formed on the inner circumferential surfaces of the screw holes 130*a* and 130*b*. The bracket 151 of the holder 150 is inserted into the rectangular opening 131, and the screws 161 and 163 are inserted into the screw through-holes 152*a* and 152*b* of the base 152 and screwed into the screw holes 130*a* and 130*b* to fix and position the holder 150 on the frame 130. As a result, the discharge brush 140 and the thermistor 120 are assembled to the fixing device 100 so as to contact the surface of the pressure roller 103.

In the present embodiment, since the holder 150 that is a single part holds the discharge brush 140 and the thermistor 120, a single assembly operation of assembling the holder 150 to the frame 130 enables assembling the discharge brush 140 and the thermistor 120 to the fixing device 100. The above-described configuration can reduce man-hours as compared with the fixing device 100 to which the discharge brush 140 and the thermistor 120 are separately assembled.

In addition, compared to the fixing device 100 including the discharge brush 140 and the thermistor 120 assembled with different holders, respectively, the above-described configuration can reduce the number of parts and the cost of the fixing device 100.

The bracket 151 is arranged on a line segment connecting two fixing positions at which the holder 150 is fixed on the frame 130.

Figure 6:
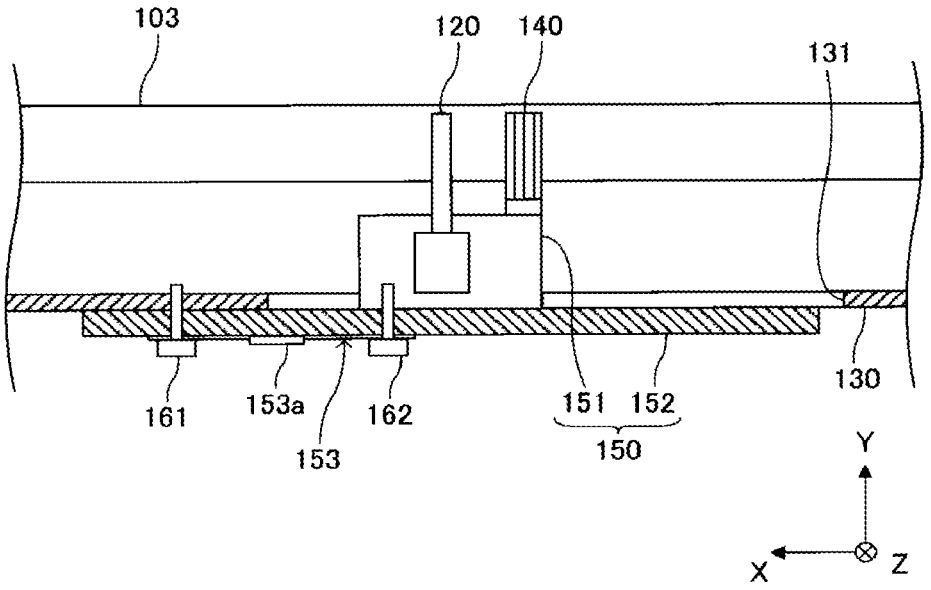
FIG. 6 is an explanatory view illustrating an example of the holder having one end portion fixed to the frame.
Figure 7A:
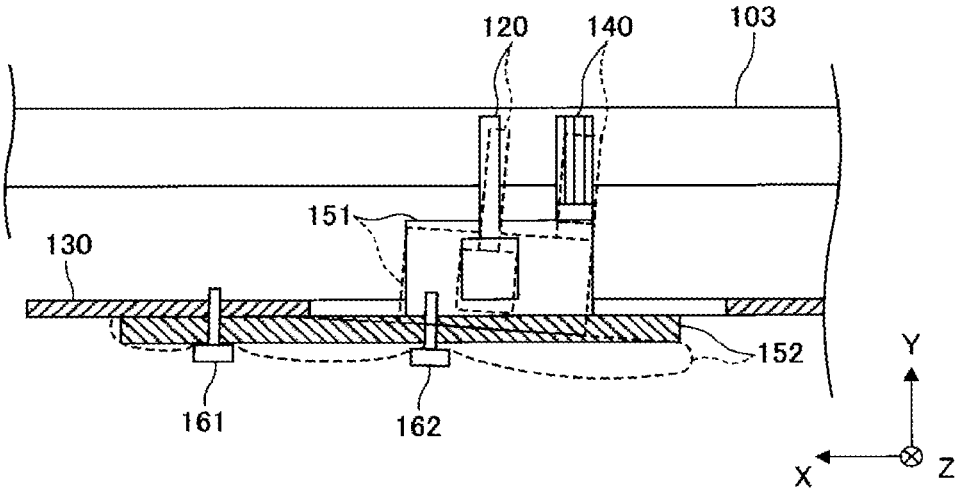
FIG. 7A is an explanatory view illustrating a thermal expansion of the base of the holder illustrated in FIG. 6.
Figure 7B:
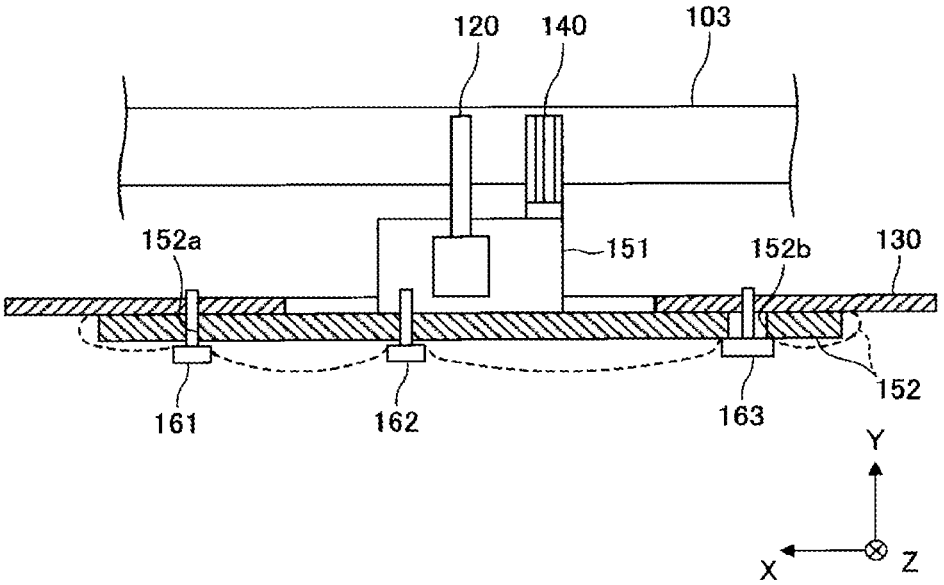
FIG. 7B is an explanatory view illustrating the thermal expansion of the base of the holder of which both end portions are fixed on the frame.

FIG. 6 is an explanatory view illustrating an example of the holder 150 having one end portion, which is the left end portion of the holder 150 in FIG. 6, fixed to the frame 130. FIG. 7A is an explanatory view illustrating a thermal expansion of the base 152 of the holder 150 illustrated in FIG. 6. FIG. 7B is an explanatory view illustrating the thermal expansion of the base 152 of the holder 150 of which both end portions are fixed on the frame 130.

In the present embodiment, to reduce the leakage of the transfer current from the transfer nip to the discharge brush 140, the base 152 is made of the insulating resin as described above, but the thermal expansion of the base 152 made of resin is large. In particular, since the temperature in the fixing device 100 becomes high, the base 152 has a large amount of thermal expansion.

As illustrated in FIG. 7A, the holder 150 having one end portion fixed to the frame 130 is cantilevered by the frame 130. As illustrated in broken lines of FIG. 7A, a thermal expansion of the base 152 of the holder 150 tilts the base 152 in a direction in which a free end portion of the base 152 that is not fixed on the frame 130 (the end portion in −X direction side and in the right side in FIG. 7A) is away from the pressure roller 103. Since the thermal expansion of the base 152 is a uniform expansion in all directions, the base 152 thermally expands toward the pressure roller 103 (in the +Y direction). A fixed end portion of the base 152 on the frame 130 (the end portion in the −X direction side and the left side in FIG. 7A) contacts the frame 130 on a surface of the base 152 on which the bracket 151 is held, that is, the surface facing the pressure roller 103. Although the thermal expansion of the base 152 presses the frame 130 against the pressure roller 103, a high rigidity of the frame 130 maintains a form of the frame 130, that is, does not deform the frame 130.

On the other hand, since the thermal expansion of the base 152 presses the frame 130, the fixed end portion of the base 152 receives a reaction force from the frame 130. The free end portion of the base 152 (the end portion in the −X direction side and the left side in FIG. 7A) freely moves in the direction in which the free end portion of the base 152 is away from the pressure roller 103, that is, the Y direction and the vertical direction in FIG. 7A. As a result, the reaction force from the frame 130 tilts the holder 150 such that the fixed end portion of the base 152 serves as a fulcrum and the free end portion separates from the pressure roller 103, as illustrated by the broken lines in FIG. 7A. Therefore, as illustrated by the broken lines in FIG. 7A, the thermistor 120 and the discharge brush 40 held on the holder 150 also tilt to the right side in FIG. 7A.

The surface of the pressure roller 103 is a cylinder surface. Accordingly, when the tilt of the thermistor 120 and the discharge brush 40 changes the positions of tips of the thermistor 120 and the discharge brush 40 from the positions prior to the thermal expansion in the direction away from the pressure roller 103, which is −Y direction, in other words, when the tips of the thermistor 120 and the discharge brush 40 move to the right side in FIG. 2, the temperature detection unit 120*a* of the thermistor 120 and the discharge brush 140 may separate from the pressure roller 103 or the contact pressure between the temperature detection unit 120*a* and the pressure roller 103 and the contact pressure between the discharge brush 140 and the pressure roller 103 may decrease.

The separation of the temperature detection unit 120*a* of the thermistor 120 from the pressure roller 103 or the decrease of the contact pressure between the temperature detection unit 120*a* and the pressure roller 103 obstructs an accurate detection of the temperature of the pressure roller 103 and an accurate control of turning on and off of the first halogen heater 102A and the second halogen heater 102B. As a result, the toner may be overheated, resulting in fixing failures such as hot offset. In addition, the separation of the discharge brush 140 from the pressure roller 103 or the decrease of the contact pressure between the discharge brush 140 and the pressure roller 103 obstructs sufficiently discharging the pressure roller 103 and may cause the electrostatic offset or a sheet separation failure.

In contrast, in the base 152 having both end portions fixed to the frame 130, the heads of the screws 161 and 163 as regulators restrict movements of both end portions of the base 152 in the direction in which the both end portions of the base 152 are brought into contact with or separated from the pressure roller 103, that is, in the Y direction. When one end portion of the base 152 receives the reaction force caused by the thermal expansion from the frame 130, the head of the screw 163 restricts the movement of the other end portion of the base 152 in the direction in which the other end portion separates from the pressure roller 103 (−Y direction, the direction toward the lower side in FIG. 7B). The above-described configuration prevents the one end portion of the holder 150 from tilting away from the pressure roller 103 due to the thermal expansion of the base 152. The screw through-hole 152*b* in the other end portion (that is, the end portion in the −X direction side and the right side in FIG. 7B) is the slot extending in the X direction. Therefore, since the screw through-hole 152*b* is the slot, the screw through-hole 152*b* allows the thermal expansion of the base 152 in the X direction and prevents the base 152 from bending between the screws 161 and 163. As a result, as illustrated in FIG. 7B, the thermal expansion of the base 152 hardly changes contact positions of the thermistor 120 and the discharge brush 140 with the pressure roller 103. Therefore, the above-described configuration can maintain the detection accuracy of the thermistor 120. In addition, the discharge brush 140 can satisfactorily discharge the pressure roller 103.

Although the holder 150 in the present embodiment includes the bracket 151 made of metal and the base 152 made of insulating resin, the holder 150 may be integrally formed by resin molding. Such a configuration has an advantage that the number of parts can be reduced. When the holder 150 is integrally formed by resin molding, coupling one end of the resistance member 153 directly to the discharge brush 140 enables electrically coupling the discharge brush 140 to the frame 130 via the resistance member 153.

On the other hand, the holder 150 made up of two parts including the bracket 151 as the support made of metal to hold the thermistor 120 and the discharge brush 140 can reduce the thermal expansion of the support to hold the thermistor 120 and the discharge brush 140. Such a configuration can decrease variation in a positional relationship between the pressure roller 103, the temperature detection unit 120*a* of the thermistor 120, and the discharge brush 140 that is caused by the thermal expansion of the support.

When the thermal expansion of the base 152 in the Z direction moves the thermistor 120 and the discharge brush 140 in the −Z direction, as can be seen from FIG. 2, the thermistor 120 and the discharge brush 140 may be separated from the pressure roller 103. Therefore, in the present embodiment, the length of the base 152 in the Z direction is designed shorter than the length of the base 152 in the X direction to reduce the amount of the thermal expansion of the base 152 in the Z direction. In addition, a fixing position of the bracket 151 to the base 152 is set the center of the base 152 in the Z direction to reduce the variation of the fixing position in the Z direction that is caused by the thermal expansion of the base 152 in the Z direction.

Alternatively, the bracket 151 may be fixed at an upper position of the base 152, that is, the position shifted in the +Z direction from the center of the base 152 in the Z direction. In the above-described configuration, the thermal expansion of the base 152 in the Z direction shifts the position at which the bracket 151 is fixed on the base 152 toward the +Z direction and can increase the contact pressure between the temperature detection unit 120*a* of the thermistor 120 and the pressure roller 103 and the contact pressure between the discharge brush 140 and the pressure roller 103.

Next, a description is given of variations of the present embodiment described above.

Figure 8:
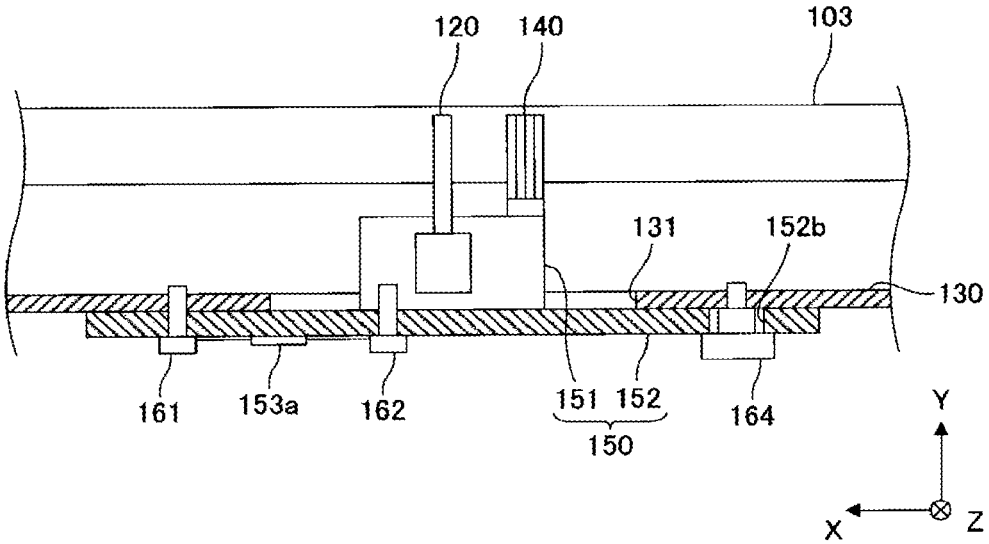
FIG. 8 is a schematic view illustrating a configuration of the holder according to a first variation.

FIG. 8 is a schematic view illustrating a configuration of the holder 150 according to a first variation.

As illustrated in FIG. 8, in the first variation, a step screw 164 fixes the other end portion of the base 152 (the end portion in the −X direction side and the right side in FIG. 8) to the frame 130.

A fastening force of the step screw 164 that fixes the other end portion of the base 152 (the end portion in the −X direction side and the right side in FIG. 8) to the frame 130 is weaker than a fastening force of the standard screw in the embodiment described above. Therefore, the other end portion of the base 152 is easily moved in the X direction (that is, a longitudinal direction of the base 152) with respect to the step screw 164. That is, since the thermal expansion of the base 152 in the X direction moves the other end portion fixed by the step screw 164 more smoothly than the other end portion fixed by the standard screw, the load stress of the base 152 fixed by the step screw 164 becomes smaller than the load stress of the base 152 fixed by the standard screw when the base 152 thermally expands.

In addition, the above-described configuration can reduce a bend of the base 152 between the screw 161 and the step screw 164 and decrease the variation in the positional relationship between the pressure roller 103 and the discharge brush 140 and the variation in the positional relationship between the temperature detection unit 120*a* of the thermistor 120 and the pressure roller 103 in the Y direction.

As described in the above embodiment, since the head of the step screw 164 as the regulator restricts the movement of the other end portion of the base 152 in the −Y direction that is the direction in which the other end portion of the base 152 separates from the pressure roller 103, when the base 152 thermally expands, the step screw 164 can prevent the inclination of the base 152 that moves the other end portion of the base 152 toward the −Y direction that is the direction in which the other end portion of the base 152 separates from the pressure roller 103.

Figure 9A:
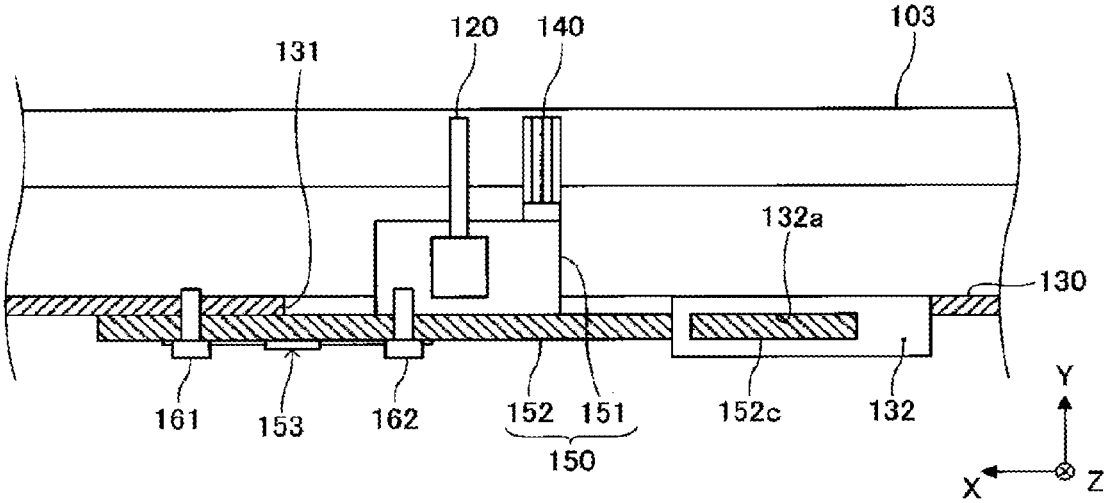
FIG. 9A is a schematic view illustrating a configuration of the holder according to a second variation viewed from the −Z direction.
Figure 9B:
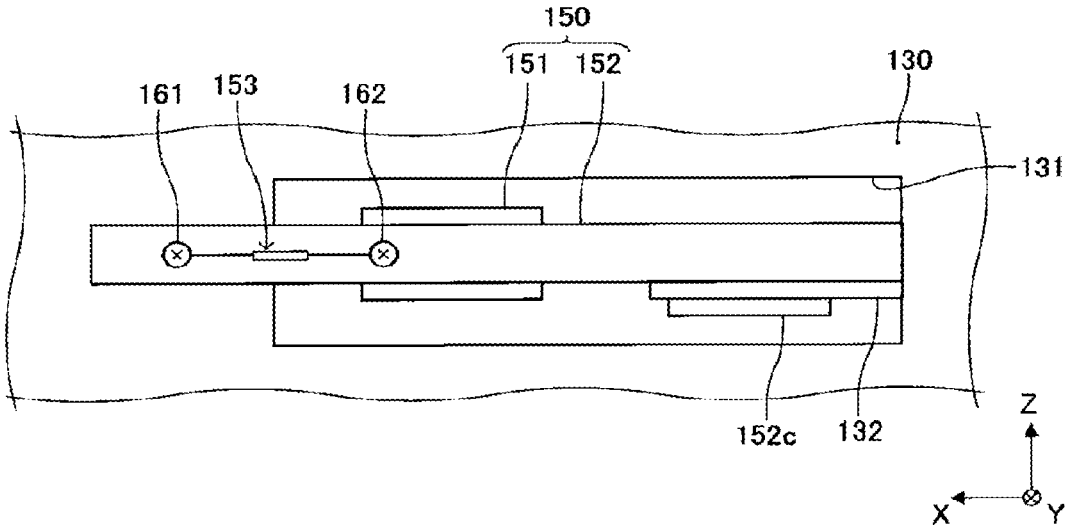
FIG. 9B is a schematic view illustrating the configuration of the holder according to the second variation viewed from the −Y direction.

Next, a second variation is described below. FIG. 9A is a schematic view illustrating a configuration of the holder 150 according to the second variation viewed from the −Z direction. FIG. 9B is a schematic view illustrating the configuration of the holder 150 viewed from the −Y direction.

In the second variation, inserting a projection into a hole fixes the other end portion of the base 152 (that is, the end portion in the −X direction side and the right side in FIGS. 9A and 9B) to the frame 130.

The other end portion of the base 152 has an insertion projection 152*c* projecting in the −Z direction, and the frame 130 has a mounting surface 132 extending in the direction orthogonal to the Z direction and having an insertion hole 132*a* into which the insertion projection 152*c* is inserted.

Inserting the insertion projection 152*c* into the insertion hole 132*a* from above (that is, toward −Z direction) fixes the other end portion of the base 152. Inserting the insertion projection 152*c* into the insertion hole 132*a* from above (that is, toward −Z direction) is preferable because the self-weight direction of the holder 150 can help inserting the insertion projection 152*c* into the insertion hole 132*a* and prevent the insertion projection 152*c* from coming out of the insertion hole 132*a*. The length of the insertion hole 132*a* in the X direction is longer than the length of the insertion projection 152*c* in the X direction to absorb the thermal expansion of the base 152 in the X direction.

In the second variation, inserting the insertion projection 152*c* into the insertion hole 132*a* in the direction orthogonal to the Y direction in which the base 152 comes into contact with and separates from the pressure roller 103 enables an inner circumferential surface of the insertion hole 132*a* as the regulator to restrict a movement of the other end portion of the base 152 in the Y direction. Therefore, as described in the above embodiment, when the base 152 thermally expands, the configuration of the second variation can prevent the inclination of the base 152 that moves the other end portion of the base 152 toward the −Y direction that is the direction in which the other end portion of the base 152 separates from the pressure roller 103.

In addition, the configuration of the second variation enables the other end portion to fix without using screws. Therefore, even in the configuration that is difficult to fix the other end portion with the screw, the other end portion can be easily fixed to the frame 130. Although FIGS. 9A and 9B illustrate the base 152 having the insertion projection and the frame 130 having the insertion hole, the frame 130 may have the insertion projection, and the base 152 may have the insertion hole.

Next, a third variation is described.

Figure 10:
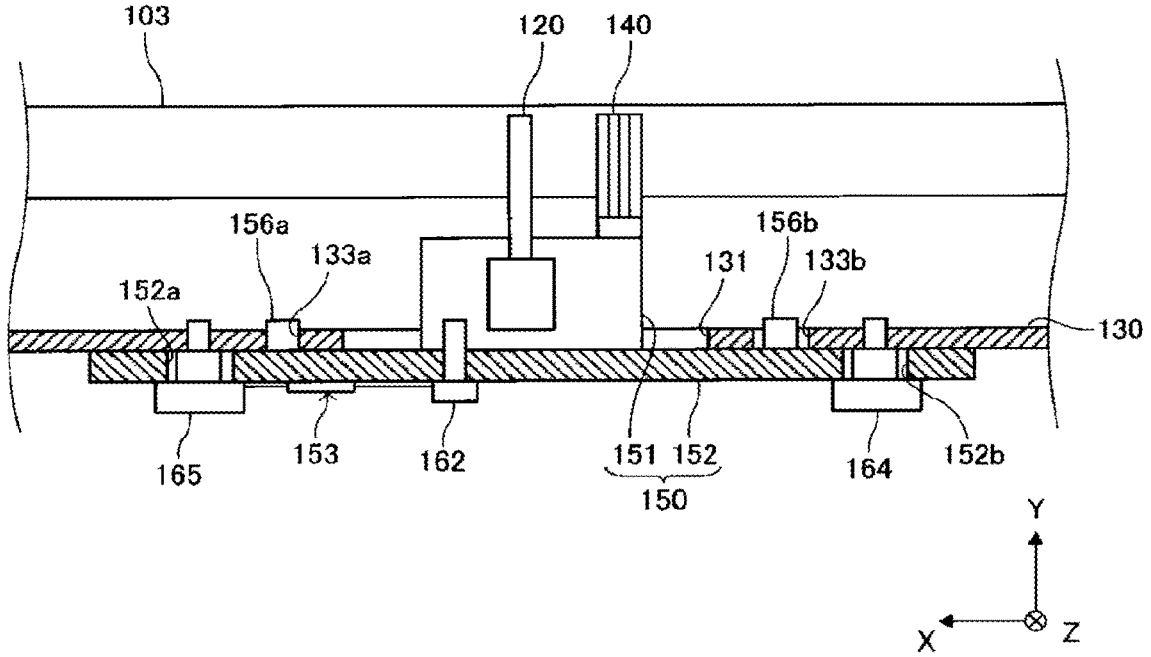
FIG. 10 is a schematic view illustrating a configuration of the holder according to a third variation.

FIG. 10 is a schematic view illustrating a configuration of the holder 150 according to the third variation.

As illustrated in FIG. 10, the holder 150 according to the third variation includes the base 152 having positioning portions to position the base 152 on the frame 130 and step screws to fix the both end portions of the base 152 in the X direction. Specifically, the base 152 has two positioning projections 156*a* and 156*b* as the positioning portions at a predetermined interval in the X direction. The frame 130 has a positioning hole 133*a* to insert the positioning projection 156*a* on the left side in FIG. and a positioning hole 133*b* to insert the positioning projection 156*b* on the right side in FIG. 10.

Positioning on the left side in FIG. 10 is designed as the main reference for positioning, and the positioning hole 133*a* is a round hole having an inner diameter slightly larger than the outer diameter of the positioning projection 156*a*. On the other hand, positioning on the right side in FIG. 10 is designed as a sub-reference for positioning, and the positioning hole 133*b* is a slot extending in the X direction. In addition, the screw through-holes 152*a* and 152*b* through which the step screws 165 and 164 penetrate are slots extending in the X direction and disposed on both sides of the base 152.

In the third variation, the positioning portion disposed in the holder 150 to position the holder 150 on the frame 130 can improve positional accuracy of the holder 150 with respect to the frame 130. In addition, the third variation can simplify a work for attaching the holder 150 to the frame 130 because inserting the positioning projections 156*a* and 156*b* into the positioning holes 133*a* and 133*b* positions the holder 150 on the frame 130 and, while positions of the screw holes 130*a* and 130*b* in the frame 130 coincide with positions of the screw through-hole 152*a* and 152*b* in the base 152, the holder 150 can be screwed to the frame 130.

Figure 11:
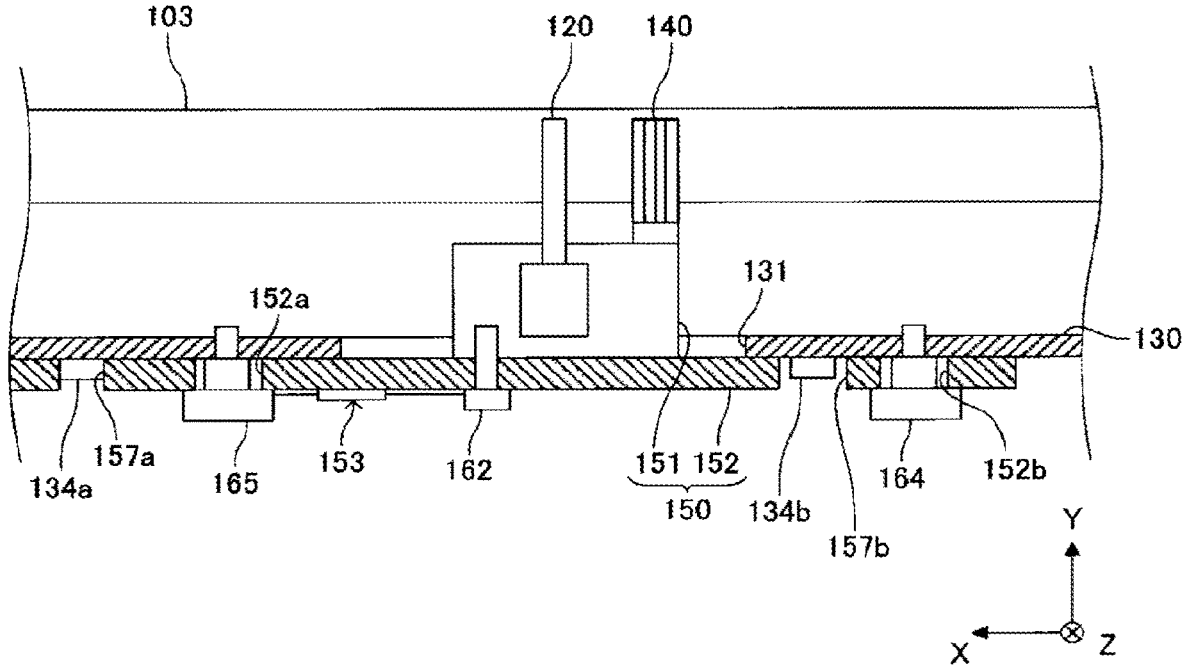
FIG. 11 is a schematic view illustrating a configuration of the holder according to the third variation having a positioning hole that accepts a positioning projection of the frame.

Alternatively, as illustrated in FIG. 11, the positioning portions of the holder 150 may be positioning holes 157*a* and 157*b*, and the positioning portions of the frame 130 may be positioning projections 134*a* and 134*b*. In FIG. 11, the step screw fixes the holder 150 to the frame 130, but the standard screw may fix the holder 150 to the frame 130.

Next, a fourth variation is described.

Figure 12:
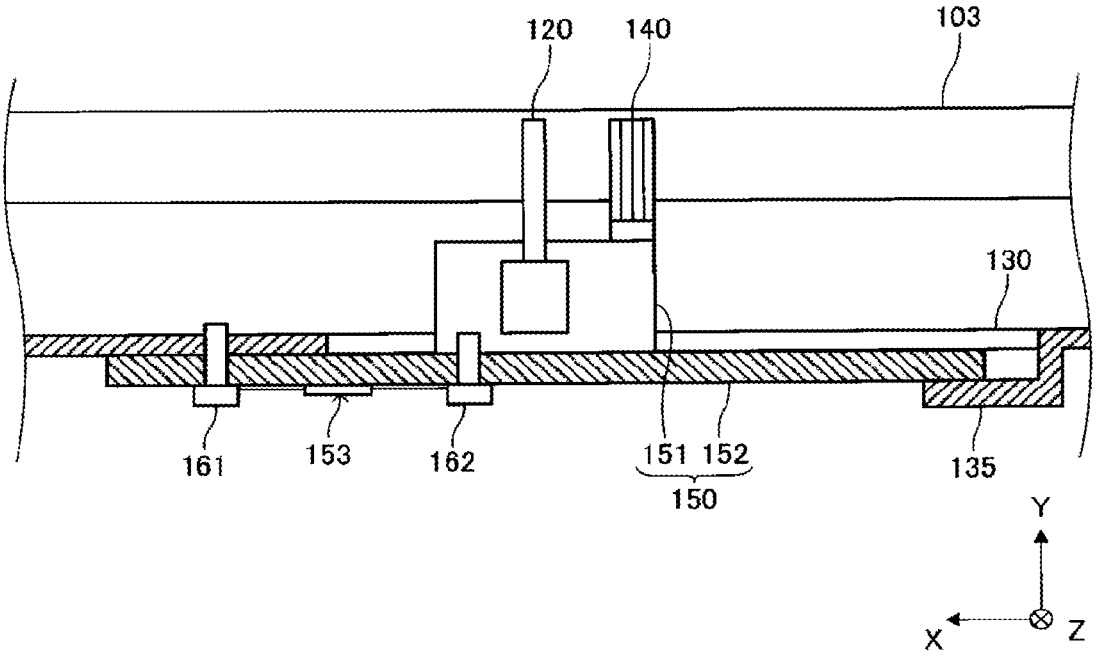
FIG. 12 is a schematic view illustrating a configuration of the holder according to a fourth variation.

FIG. 12 is a schematic view illustrating a configuration of the holder 150 according to the fourth variation.

The holder 150 according to the fourth variation includes the frame 130 having a restriction surface 135 facing a surface of the other end portion of the base 152 (that is, the end portion in the −X direction side and the right side in FIG. 12) and the surface opposite to a surface holding the bracket 151. The restriction surface 135 restricts the movement of the other end portion of the base 152 in the direction in which the other end portion of the base 152 separates from the pressure roller 103.

In the above-described configuration, the restriction surface 135 can restrict the movement of the other end portion of the base 152 in the direction in which the other end portion of the base 152 separates from the pressure roller 103 when the base 152 thermally expands and prevent the thermistor 120 and the discharge brush 140 from separating from the pressure roller 103.

Note that the configuration of the fourth variation does not restrict the movement of the other end portion of the base 152 in the +Y direction that is the direction in which the other end portion of the base 152 approaches the pressure roller 103. Therefore, when the base 152 thermally expands, a reaction force of the restriction surface 135 may cause the inclination of the base 152 that moves the other end portion of the base 152 toward the +Y direction that is the direction in which the other end portion of the base 152 approaches the pressure roller 103. The above-described inclination of the base 152 causes a displacement of the thermistor 120 in the +Y direction. However, when the conducting wire 120*b* of the thermistor 120 is not parallel to the tangential direction at the contact position between the thermistor 120 and the pressure roller 103, the displacement of the thermistor 120 in the +Y direction does not cause a separation of the temperature detection unit 120*a* at the tip of the thermistor 120 from the pressure roller 103. Therefore, when the conducting wire 120*b* of the thermistor 120 is not parallel to the tangential direction at the contact position between the thermistor 120 and the pressure roller 103, the configuration of the fourth variation may be adopted.

Figure 13A:
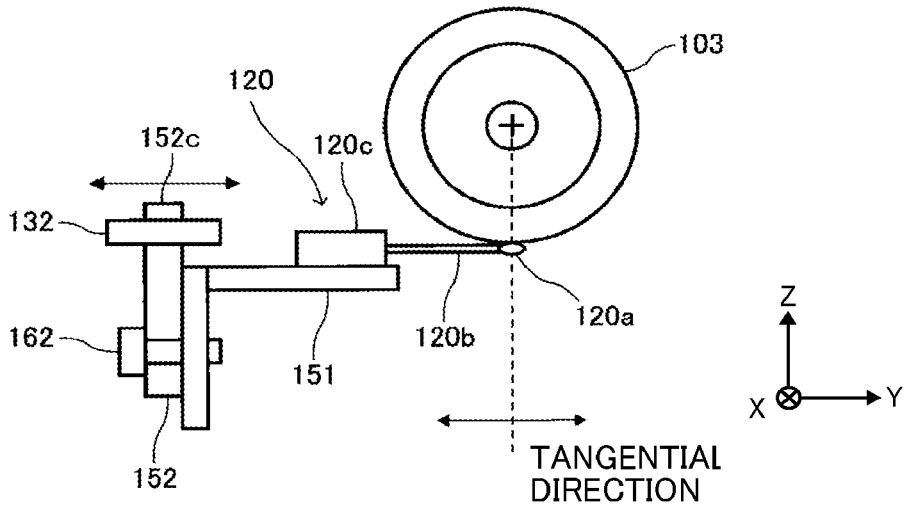
FIGS. 13A and 13B are explanatory views each illustrating an example of a thermistor including a conducting wire that is parallel to a tangential direction of the pressure roller at a contact position between the thermistor and the pressure roller.
Figure 13B:
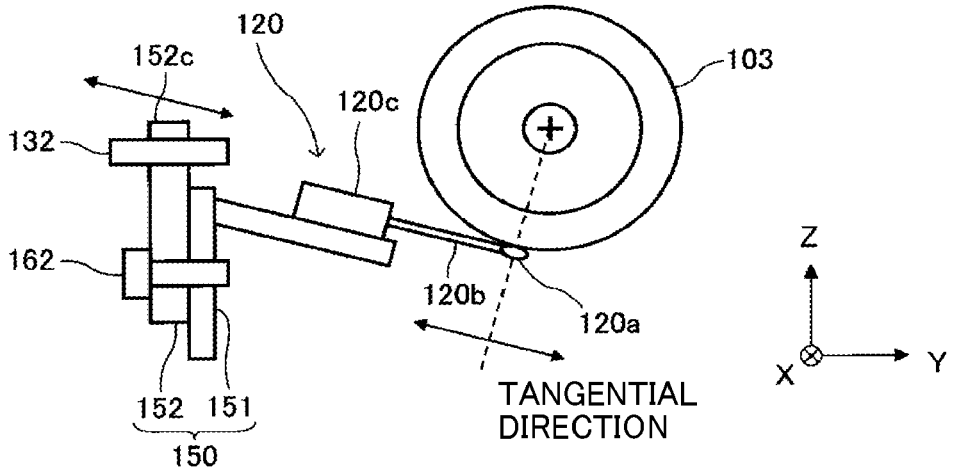

On the other hand, when the conducting wire 120*b* of the thermistor 120 is parallel to the tangential direction at the contact position between the thermistor 120 and the pressure roller 103 as illustrated in FIGS. 13A and 13B, the displacement of the thermistor 120 in the +Y direction may cause the separation of the temperature detection unit 120*a* at the tip of the thermistor 120 from the pressure roller 103. Therefore, the configuration including the thermistor 120 that is held so that the conducting wire 120*b* of the thermistor 120 is parallel to the tangential direction at the contact position between the thermistor 120 and the pressure roller 103 needs to be configured so that the thermal expansion of the base 152 does not cause the displacement of the temperature detection unit 120*a* with respect to the pressure roller 103 in both of the +Y direction that is the direction in which the other end portion of the base 152 approaches the pressure roller 103 and the −Y direction that is the direction in which the other end portion of the base 152 is away from the pressure roller 103.

Therefore, in the configuration including the thermistor 120 that is held so that the conducting wire 120*b* of the thermistor 120 is parallel to the tangential direction at the contact position between the thermistor 120 and the pressure roller 103, preferably, both end portions of the base 152 in the X direction are fixed by the screws, the step screws, or the configuration according to the second variation as illustrated in FIGS. 9A and 9B. Configurations illustrated in FIGS. 13A and 13B include the other end portion of the base 152 having the insertion projection 152*c* projecting in the Z direction and the frame 130 having the mounting surface 132 extending in the direction orthogonal to the Z direction and having the insertion hole 132*a* into which the insertion projection 152*c* is inserted, as described in the second variation.

Figure 14A:
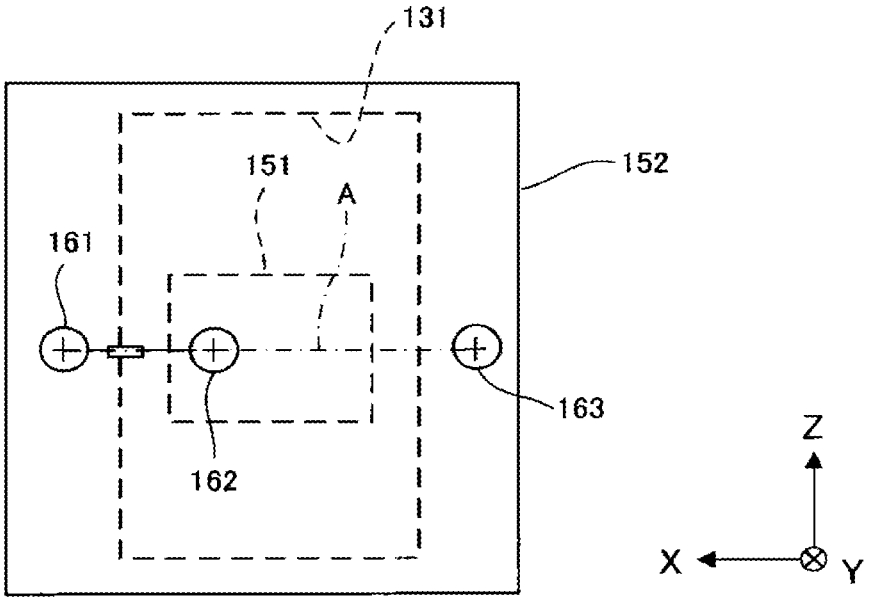
FIGS. 14A and 14B are explanatory views illustrating an arrangement of a support.

In addition, as illustrated in FIG. 14A, the bracket 151 as the support is disposed on the line connecting the screws 161 and the screws 163 that are the regulators (that is, a dash-dot-dash line A in FIG. 14A). As illustrated in FIG. 14A, since the screws 161 and 163 do not restrict the thermal expansion of the base 152 in the Y direction, the thermal expansion of the base 152 may deform an upper portion of the base 152 and a lower portion of the base 152 that are away from the dash-dot-dash line A in a direction in which the upper portion and the lower portion separate from the pressure roller 103. On the other hand, in a portion of the base 152 around the dash-dot-dash line A, since the screws 161 and 163 fix the base 152, the thermal expansion of the base 152 does not largely affect positions on the base 152 in the Y direction. Therefore, disposing the bracket 151 on the dash-dot-dash line A can reduce the displacement of the thermistor 120 and the discharge brush 140 when the base 152 thermally expands.

Figure 14B:
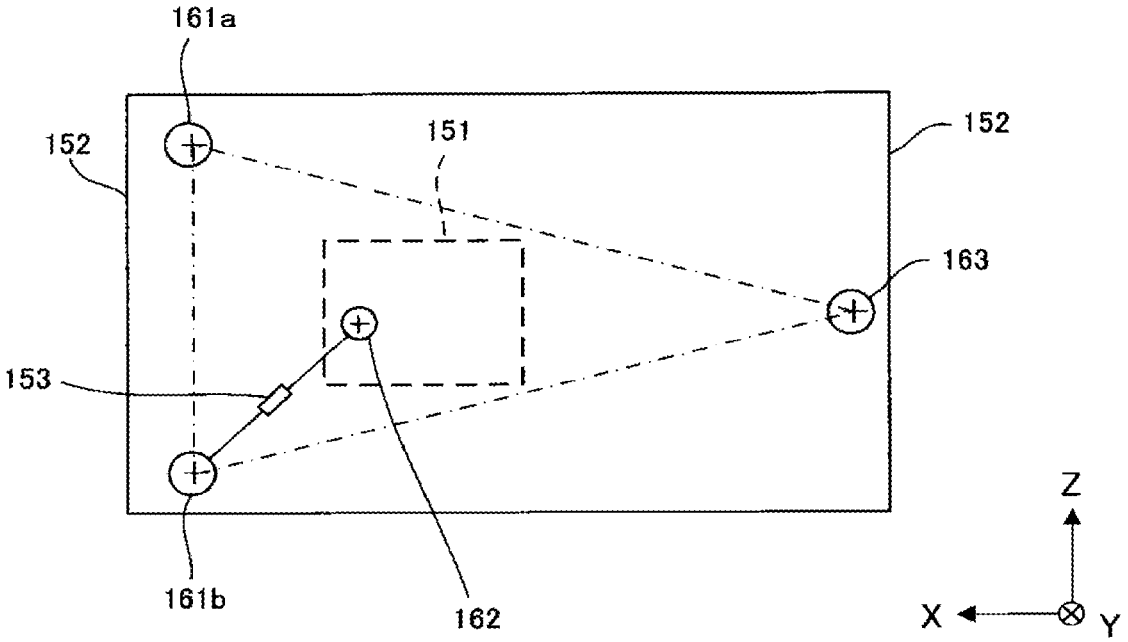

Alternatively, the base 152 may be fixed to the frame 130 at three or more positions. In such a configuration, as illustrated in FIG. 14B, the screws 161*a*, 161*b*, and 163 as the regulators sufficiently restrict displacement of positions on the base 152 in the Y direction inside a polygonal shape (that is a triangle in FIG. 14B) formed by connecting the screws 161*a*, 161*b*, and 163. Therefore, disposing the bracket 151 inside the polygonal shape (the triangle in FIG. 14B) formed by connecting the screws 161*a*, 161*b*, and 163 can reduce the displacement of the thermistor 120 and the discharge brush 140 when the base 152 thermally expands.

In the present embodiment, the thermistor 120 and the discharge brush 140 are brought into contact with the pressure roller 103 as a pressure rotator but may be brought into contact with the fixing rotator.

The structures described above are just examples, and the various aspects of the present disclosure attain respective effects as follows.

First Aspect

A fixing device such as the fixing device 100 according to a first aspect includes a fixing rotator such as the fixing belt 101, a pressure rotator such as the pressure roller 103 configured to press the fixing rotator, a fixing structure such as the frame 130 configured to hold at least one of the fixing rotator and the pressure rotator, a temperature detector such as the thermistor 120 configured to contact a detected member that is at least one of the fixing rotator and the pressure rotator (in the above-described embodiments, the pressure roller 103) and detect a temperature of the detected member, a discharger such as the discharge brush 140 configured to contact and discharge the detected member, and a holder such as the holder 150 fixed on the fixing structure and configured to hold the temperature detector and the discharger.

A charged fixing rotator or a charged pressure rotator may cause the sheet separation failure because the charged fixing rotator or the charged pressure rotator electrostatically attracts the sheet, and an electric potential difference between the fixing rotator and the pressure rotator may cause the electrostatic offset in which the toner on the sheet adheres to the fixing rotator. Therefore, the discharger contacts and discharges at least one of the fixing rotator and the pressure rotator to prevent occurrences of the separation failure and decrease the electrostatic offset.

Disposing the temperature detector and the discharger on different holders increases the number of assembling steps to fix the holders to the fixing structure. In addition, an increase in the number of parts increases a manufacturing cost.

Therefore, in the first aspect, the temperature detector and the discharger are configured to contact at least one of the fixing rotator and the pressure rotator, and the holder holds the discharger and the temperature detector.

The above-described structure can reduce the number of the holder to one and decrease the number of parts and the manufacturing cost. In addition, a single assembly operation of assembling the holder to the fixing structure enables assembling the discharger and the temperature detector to the fixing device, which can reduce the man-hours.

Second Aspect

In addition to the fixing device according to the first aspect, the fixing device according to a second aspect further includes a plurality of regulators such as the screws 161 and 163 configured to restrict the movement of the holder such as the holder 150 in the direction away from the detected member such as the pressure roller 103 and a support such as the bracket 151 configured to hold the discharger such as the discharge brush 140 and the temperature detector such as the thermistor 120 in the holder 150 and disposed on a line connecting two regulators of the plurality of regulators or inside a polygonal shape formed by connecting three or more regulators of the plurality of regulators.

According to the second aspect, as described with reference to FIGS. 14A and 14B, the regulator restricts the base such as the base 152 on the line connecting the two regulators or inside the polygonal shape formed by connecting the three or more regulators to reduce the displacement in the direction in which the support is away from the detected member such as the pressure roller 103 when the base such as the base 152 of the holder 150 thermally expands.

Therefore, the support such as the bracket 151 configured to hold the temperature detector such as the thermistor 120 and the discharger such as the discharge brush 140 is disposed on the line connecting the two regulators or inside the polygonal shape formed by connecting the three or more regulators to reduce the displacement of the support in the direction away from the detected member. Reducing the displacement of the support reduces the displacement of the temperature detector and the discharger that are held on the support in the direction away from the detected member.

As a result, the second aspect can prevent the temperature detector and the discharger from separating from the detected member when the base thermally expands. Therefore, the second aspect enables the temperature detector to accurately detect the temperature of the detected member and the discharger to effectively discharge the detected member.

Third Aspect

In addition to the fixing device according to the first aspect or the second aspect, the fixing device according to a third aspect includes the fixing structure such as the frame 130 made of metal and the holder including the base made of the insulating resin such as the base 152 to fix the holder such as the holder 150 on the fixing structure and the resistor that electrically couples the fixing structure to the discharger such as the discharge brush 140 and has an electrical resistance larger than an electrical resistance of the fixing structure and smaller than an electrical resistance of the base.

As described in the embodiment, the third aspect provides an inexpensive configuration that reduces leakage of the transfer current to the discharger when the recording medium such as the sheet is sandwiched in both the transfer nip and the fixing nip and enables the discharger to discharge the detected member such as the pressure roller 103.

Fourth Aspect

The fixing device according to a fourth aspect, in addition to the fixing device according to the second aspect or the third aspect, includes the detected member such as the pressure roller 103 having a cylindrical shape and the plurality of regulators configured to restrict the movement of the holder in the tangential direction at the contact position between the detected member and the temperature detector such as the thermistor 120.

As described with reference to FIGS. 13A and 13B, the fourth aspect can prevent a temperature detection unit such as the temperature detection unit 120*a* at the tip of the thermistor 120 from separating from the surface of the detected member such as the pressure roller 103 even when the temperature detector such as the thermistor 120 is arranged in parallel to the tangential direction.

Fifth Aspect

The fixing device according to a fifth aspect, in addition to the fixing device according to any one of the second aspect to the third aspect, includes the plurality of regulators including at least one screw such as the screw 161 to screw the holder such as the holder 150 to the fixing structure such as the frame 130 and a step screw such as the step screw 164 to screw the holder 150 to the fixing structure.

As described in the first variation, the fifth aspect can change the load stress of the base such as the base 152 of the holder 150 smaller than the load stress of the base fixed by the standard screws at both end portions because the step screw such as the step screw 164 allows the movement caused by the thermal expansion of the base in the X direction that is the longitudinal direction of the base such as the base 152, that is, the direction orthogonal to the direction away from the detected member such as the pressure roller 103.

Sixth Aspect

The fixing device according to a sixth aspect, in addition to the fixing device according to any one of the second aspect to the fourth aspect, includes the plurality of regulators including at least one regulator that includes the insertion projection 152*c* disposed on one of the holder 150 and the fixing structure such as the frame 130 (in the present embodiment, the holder 150) and an insertion hole such as the insertion hole 132*a* disposed on the other (in the present embodiment, the frame 130), and an insertion projection such as the insertion projection 152*c* projects in the direction orthogonal to the direction away from the detected member such as the pressure roller 103 and is configured to be inserted into the insertion hole such as the insertion hole 132*a*.

As described in the second variation, the regulator in the sixth aspect can restrict the movement of the holder such as the holder 150 in the direction in which the holder separates from the detected member such as the pressure roller 103 without using the screw or the step screw.

Seventh Aspect

The fixing device according to a seventh aspect, in addition to the fixing device according to any one of the second aspect to the fourth aspect, includes the plurality of regulators including at least one regulator that includes a contact surface such as the restriction surface 135 of the fixing structure such as the frame 130. The holder such as the holder 150 contacts the contact surface in the direction in which the holder separates from the detected member such as the pressure roller 103.

As described in the fourth variation, the seventh aspect can simplify a configuration to restrict the movement of the holder such as the holder 150 in the direction in which the holder separates from the detected member such as the pressure roller 103.

Eighth Aspect

In an eighth aspect, the fixing device according to any one of the first aspect to the seventh aspect includes the holder such as the holder 150 having the positioning portion to position the holder on the fixing structure such as the frame 130.

As described in the third variation, the eighth aspect can improve the positional accuracy of the holder such as the holder 150 with respect to the fixing structure such as the frame 130.

Ninth Aspect

In a ninth aspect, an image forming apparatus such as the image forming apparatus 200 includes an image forming device to form the toner image on the recording medium such as the sheet P and the fixing device according to any one of the first aspect to the eighth aspect to fix the toner image onto the recording medium.

The ninth aspect can reduce the cost of the image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a fixing rotator;

a pressure rotator configured to press the fixing rotator;

a fixing structure configured to hold at least one of the fixing rotator and the pressure rotator;

a temperature detector configured to contact a detected member that is at least one of the fixing rotator and the pressure rotator and detect a temperature of the detected member;

a discharger configured to contact and discharge the detected member; and a holder fixed on the fixing structure and configured to hold the temperature detector and the discharger.

2. The fixing device according to claim 1, further comprising:

a plurality of regulators configured to restrict a movement of the holder in a direction away from the detected member, wherein the holder includes a support configured to hold the discharger and the temperature detector and disposed on a line connecting two regulators of the plurality of regulators or inside a polygonal shape formed by connecting three or more regulators of the plurality of regulators.

3. The fixing device according to claim 2, wherein the detected member has a cylindrical shape, and the plurality of regulators is configured to restrict a movement of the holder in a tangential direction at a contact position between the detected member and the temperature detector.

4. The fixing device according to claim 2, wherein the plurality of regulators includes:

at least one screw configured to screw the holder to the fixing structure; and a step screw configured to screw the holder to the fixing structure.

5. The fixing device according to claim 2, wherein at least one of the plurality of regulators includes:

an insertion projection disposed on one of the holder and the fixing structure and projecting in a direction orthogonal to a direction away from the detected member; and an insertion hole disposed on the other one of the holder and the fixing structure to insert the insertion projection.

6. The fixing device according to claim 2, wherein at least one of the plurality of regulators includes a contact surface of the fixing structure that the holder is configured to contact in a direction away from the detected member.

7. The fixing device according to claim 1, wherein the fixing structure is made of metal, and the holder includes:

a base made of insulating resin and fixed on the fixing structure; and a resistor held by the holder and configured to electrically couple the fixing structure to the discharger, the resistor having an electrical resistance larger than an electrical resistance of the fixing structure and smaller than an electrical resistance of the base.

8. The fixing device according to claim 7, further comprising a plurality of regulators configured to restrict a movement of the holder in a tangential direction at a contact position between the detected member and the temperature detector, wherein the detected member has a cylindrical shape.

9. The fixing device according to claim 7, further comprising a plurality of regulators that includes:

at least one screw configured to screw the holder to the fixing structure; and a step screw configured to screw the holder to the fixing structure.

10. The fixing device according to claim 7, further comprising a plurality of regulators that includes at least one regulator including:

an insertion projection disposed on one of the holder and the fixing structure and projecting in a direction orthogonal to a direction away from the detected member and an insertion hole disposed on the other one of the holder and the fixing structure to insert the insertion projection.

11. The fixing device according to claim 7, further comprising a plurality of regulators that includes at least one regulator including a contact surface of the fixing structure that the holder is configured to contact in a direction away from the detected member.

12. The fixing device according to claim 1, wherein the holder includes a positioning portion configured to position the holder on the fixing structure.

13. An image forming apparatus comprising:

an image forming device configured to form an image on a recording medium; and the fixing device according to claim 1 configured to fix the image on the recording medium.

* * * * *